United States Patent [19]

Aleman

[11] 4,030,144

[45] June 21, 1977

[54] APPARATUS AND ARRANGEMENT FOR CONSERVING WATER FOR TOILET FLUSHING

[76] Inventor: Augusto Cuevas Alemán, Maria de la Luz Bringas No. 44, Colonia del Valle, Mexico 12, D.F., Mexico

[22] Filed: Sept. 2, 1975

[21] Appl. No.: 609,668

[52] U.S. Cl. ..... 4/3; 4/18 R; 4/166

[51] Int. Cl.[2] ..... A47K 4/00

[58] Field of Search ..... 4/1, 10, 2, 3, 67 R, 4/166, 167, 187 R, 18 R, 115

[56] References Cited

UNITED STATES PATENTS

| | | | |
|---|---|---|---|
| 1,140,420 | 5/1915 | Thomas | 138/41 |
| 1,957,829 | 5/1934 | Greenwald | 138/41 |
| 2,645,099 | 7/1953 | Cumming | 138/41 X |
| 3,015,827 | 1/1962 | Iwata | 4/67 R |
| 3,124,808 | 3/1964 | Tiller | 4/3 |
| 3,587,116 | 6/1971 | Quase | 4/10 |
| 3,594,825 | 7/1971 | Reid | 4/2 |

*Primary Examiner*—Henry K. Artis
*Attorney, Agent, or Firm*—Albert L. Jeffers; Roger M. Rickert

[57] ABSTRACT

A method and apparatus for conserving water in which water which has once been used as for washing, or the like, in a wash basin is drained therefrom into the tank of a flush toilet so that the water is first used for washing or other sanitary purposes and is then used a second time for flushing the toilet.

2 Claims, 1 Drawing Figure

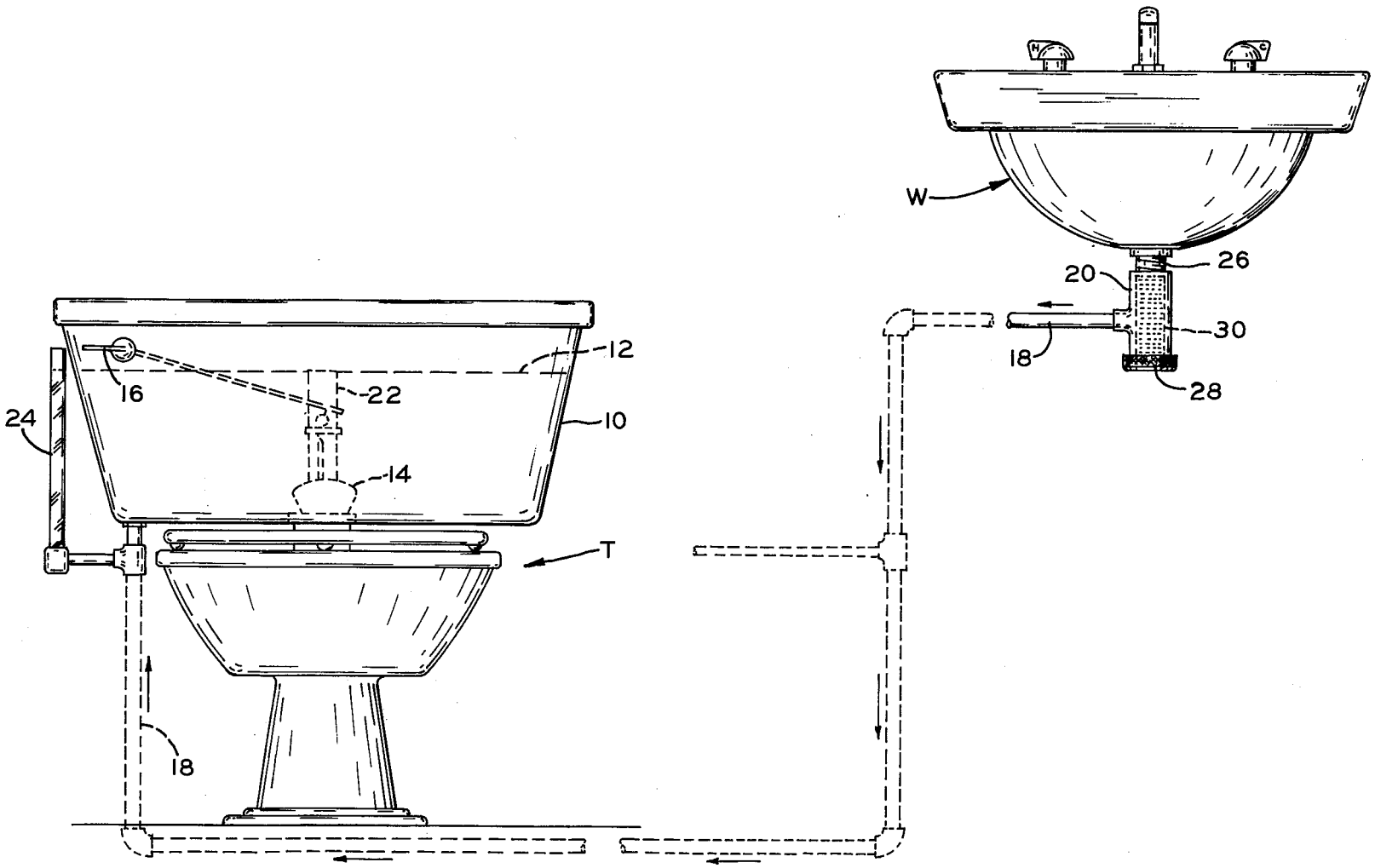
26
30
28
20
18
W
12
10
T
22
14
16
18
24

APPARATUS AND ARRANGEMENT FOR CONSERVING WATER FOR TOILET FLUSHING

The present invention relates to a method and apparatus for conserving water and is particularly concerned with an arrangement wherein water that has been once used as, for example, in a wash stand, or wash basin, or the like, and drained off to the flush tank of a flush toilet which is filled thereby to a predetermined level, and which will permit the second use of the water when the toilet is flushed.

The primary objective of the present invention is to provide an arrangement for conserving water and which will be particularly useable in water scarce regions but which will also have general utility for economy purposes.

Another object of the present invention is the provision of an arrangement whereby water which contains soap or the like, and which has been previously used for washing purposes is conveyed to the flush tank of a toilet so that it can be used a second time in flushing the toilet.

Another object is the provision of an arrangement of the nature referred to which is simple to install and which can readily be maintained and which will not interfere in any way with the operation of either the piece of equipment supplying the water, or of the flush tank of the toilet.

BRIEF SUMMARY OF THE INVENTION

According to the present invention, the bottom outlet from any piece of sanitary equipment, such as a wash stand, or shower, or the like, and from which there is normally drained soapy waters or what might be referred to as "white waters", is connected to the tank of a flush toilet or water closet so that the water which is normally discarded from the sanitary device is used to flush the toilet.

According to the present invention, the system has a pipe leading from the bottom drain of a wash stand, or the like, into the flush tank of the toilet or water closet with the water discharged from the wash stand flowing by gravity into the tank. The wash stand bottom drain is above the level to which the tank is to be filled and thus no problems arise in connection with the flow of water into the tank. Such a tank normally includes an overflow connection so that any water in excess of that acquired to fill the tank to the desired level will overflow to drain.

It is advantageous to form the conduit connecting the wash stand with the water closet tank from non-corroding material, such as plastic or stainless steel. It is also preferable to effect the connection to the bottom drain of the wash stand by means of a 'T' fitting having the conduit leading to the tank connected to the side outlet thereof and with a nonrusting screen element, such as stainless steel, within the 'T' fitting. The screen is readily accessible by the removal of a bottom closure detachably mounted on the 'T' fitting.

The normal water supply mechanism to the water closet flush tank can be eliminated and also the drain system from the wash stand, or the like, can also be eliminated.

It is also advantageous to provide the water closet tank with a gauge, such as a conventional sight gauge, mounted outside the tank so that the water level within the tank can readily be determined so that it is assured that there is ample water available for flushing the toilet when the necessity arises. Should the water level in the toilet tank be deficient for the aforementioned purposes it can readily be filled by running water into the wash stand, or the like, which is connected to the tank.

The exact nature of the present invention and the objects referred to above become more apparent upon reference to the accompany drawing which schematically illustrates a system of the nature referred to.

DETAILED DESCRIPTION OF THE INVENTION

Referring to the drawings somewhat more in detail, there is illustrated in the drawings a toilet, generally indicated by reference number T, and which includes a flush tank 10 which is to be filled to the level indicated by the dashed line 12. The tank includes therein the flush ball 14 adapted for actuation by the lever mechanism 16 when the toilet is to be flushed. This much of the toilet arrangement is standard and conventional.

The toilet arrangement, however, has no conventional fill type arrangement but, instead, has a conduit 18 connected thereto which leads to the side outlet of a 'T' fitting 20 connected to the bottom drain outlet of a wash stand, generally indicated at W.

It will be noted that the side outlet of the 'T' fitting 20 is at a substantially higher level that the level 12 in tank 10 so that water draining from the bottom drain opening of wash stand W will flow through conduit 18 into tank 10 and will readily fill it to level 12. Contained within tank 10 is an overflow pipe 22, the lower end of which is connected to drain and the upper end of which is open and is located at level 12 so that any excess of water supplied to tank 10 will overflow through conduit 22 to drain.

There is also advantageously connected, either to the tank or conduit 18, a sight glass 24 by means of which the level in the tank can readily be ascertained so that if, for any reason, the tank 10 is not filled to level 12, more water can be supplied thereto by opening a water supply valve, or faucet, pertaining to wash basin W.

The 'T' fitting 20 is formed so that the upper end is connected to the bottom drain opening 26 of wash stand W, while conduit 18 is connected to the side outlet. The lower end of 'T' fitting 20 has a closure or cap 28 removably mounted thereon and inside the 'T' fitting is a screen element 30, which may be made of stainless steel and the like to eliminate corrosion.

All of the water drained from wash stand W flows through screen 30 in passing into conduit 18. Closure cap 28 on the bottom of 'T' fitting may, if desired, be connected to the screen 30, or the screen may be loosely disposed in the 'T' fitting and be accessible by removal of closure cap 28. In this manner, the screen can be cleaned at any time while foreign matter is prevented from flowing through conduit 18 into tank 10.

In the arrangement described above, there is no problem in connection with draining the wash stand W because the discharge therefrom will flow into tank 10 and any excess over what is required to fill the tank 10 will discharge through conduit 22 to drain Similarly, there are no problems in connection with flushing toilet T because if the sight glass 24 indicates that the level in tank 10 is insufficient for proper flushing, a faucet pertaining to the wash stand W can be opened and the water will flow to the tank 10 and bring the level up to the desired point, whereupon the faucet can be closed and the tank will then be in flushing condition.

By the described arrangement, water which is normally discarded following the washing of one's hands or face, and which water is suitable for the purpose of flushing a toilet, is recovered for the flushing operation in the flush tank of the toilet.

In a two story installation, or the like, it would, of course, be possible to run water from a bathtub, or shower, or wash stand or wash basin, or the like, on an upper level into a toilet flush tank at a lower level and the same sort of system as has been described above would result.

Modifications may be made within the scope of the appended claims.

What is claimed is:

1. In a combination; a tank for a flush toilet adapted to be filled to a predetermined level; a wash basin adapted to receive water; a drain being positioned in said basin at the lowermost level of said basin for water flow from said basin; a continuous fluid conduit connecting said drain in uninterrupted fluid flow in relation to said tank; overflow means in said tank for preventing filling of said tank above said predetermined level;

a fluid inlet at the lowermost portion of said tank; said conduit being coupled to said inlet;

a transparent tube being in fluid communication with said conduit adjacent said fluid inlet; said tube having a portion extending vertically upwardly from said inlet exteriorly of said tank to a vertical level higher than said predetermined level, with the fluid level in said tube indicating the fluid level in said tank.

2. In combination; a tank for a flush toilet adapted to be filled to a predetermined level; a container adapted to receive water; a drain being positioned in said container at substantially the lowermost level of said container for water flow from said container; a fluid conduit connecting said drain to said tank; a fluid inlet coupled to said conduit at substantially the lowermost portion of said tank, characterized by a transparent tube being in fluid communication with said conduit adjacent said fluid inlet;

said tube having a portion extending vertically upwardly from said inlet exteriorly of said tank to a vertical level higher than said predetermined level with the fluid level in said tube, with the fluid level in the tube indicating the fluid level in said tank and the need for replenishing the water in said tank from said container.

* * * * *